US010675888B1

(12) United States Patent
Liu et al.

(10) Patent No.: US 10,675,888 B1
(45) Date of Patent: Jun. 9, 2020

(54) METHOD FOR MANUFACTURING THERMAL PRINT HEAD

(71) Applicant: CHIEN HWA COATING TECHNOLOGY, INC., Hsinchu (TW)

(72) Inventors: Chih-Hui Liu, Hsinchu (TW); Yi-Wei Lin, Hsinchu (TW); Chun-Chen Chen, Hsinchu (TW)

(73) Assignee: Chien Hwa Coating Technology, Inc., Hsinchu (TW)

( * ) Notice: Subject to any disclaimer, the term of this patent is extended or adjusted under 35 U.S.C. 154(b) by 0 days.

(21) Appl. No.: 16/244,233

(22) Filed: Jan. 10, 2019

(30) Foreign Application Priority Data

Dec. 7, 2018 (TW) ..... 107144236 A

(51) Int. Cl.
*B41J 2/335* (2006.01)
*B41M 3/12* (2006.01)

(52) U.S. Cl.
CPC ..... *B41J 2/3359* (2013.01); *B41J 2/3351* (2013.01); *B41J 2/33525* (2013.01); *B41M 3/12* (2013.01); *B41J 2202/22* (2013.01)

(58) Field of Classification Search
CPC .... B41J 2/3359; B41J 2/3351; B41J 2/33525; B41J 2202/22; B41M 3/12
USPC ..... 216/27, 33, 75, 76
See application file for complete search history.

(56) References Cited

U.S. PATENT DOCUMENTS

2010/0289853 A1* 11/2010 Chen ..... B41J 2/1408 347/44
2011/0122205 A1* 5/2011 Hirai ..... B41J 2/14233 347/70
2012/0055702 A1* 3/2012 Rathburn ..... H01L 23/4985 174/254
2018/0029365 A1* 2/2018 Kira ..... B41J 2/14048
2019/0240980 A1* 8/2019 Schina ..... B41J 2/14088

* cited by examiner

*Primary Examiner* — Binh X Tran
(74) *Attorney, Agent, or Firm* — Rosenberg, Klein & Lee

(57) ABSTRACT

The present invention relates to a method for manufacturing a thermal print head. Dispose a silicon substrate on a carrier, and dispose sequentially a glaze layer, a thermal resistance layer, an electrode pattern layer, and a passivation layer on the silicon substrate for forming a thermal print head. In addition, the size of the silicon substrate disposed on the carrier can be changed according to the opening on the carrier for providing a large-size thermal print head or one-time large-size printing.

7 Claims, 3 Drawing Sheets

METHOD FOR MANUFACTURING THERMAL PRINT HEAD

FIELD OF THE INVENTION

The present invention relates generally to a thermal print head, and particularly to a method for manufacturing a thermal print head.

BACKGROUND OF THE INVENTION

The decalcomania printing originated from the 18th century. In the 1950's, the term "decal" roughly means water transfer printing. In the 1960's, the thermal release transfer printing technology was developed. In recent years, various transfer printing methods have appeared. The objects to be printed extended from planes to curved surfaces, and from paper to diversified materials such as plastics or metals, making the applications of the technology very extensive. To overcome the bottlenecks caused by the physical and transfer properties of different objects to be printed, various decalcomania printing forms are developed.

Specifically, decalcomania printing is a printing method of transferring the graphs or text on an intermediate carrier to an object to be printed by corresponding pressure. According to the sources of pressure, decalcomania printing can be classified to thermal decalcomania printing, water decalcomania printing, air decalcomania printing, silk-screen decalcomania printing, and low-temperature decalcomania printing.

Thermal decalcomania printing refers to printing graphs or text on a functional intermediate carrier such as paper or decalcomania film using thermal decalcomania ink. Afterwards, the intermediate carrier is heated to a certain temperature (normally 180~230° C.) within a few minutes by using corresponding decalcomania equipment for transferring the graphs or text on the carrier to different materials.

In general, printers adopting the thermal decalcomania principle mainly use a thermal print head (TPH) module to heat the color ribbon and vaporize the dye thereon for transferring to the carrier such as paper or plastics. According to the heating time or temperature, continuous color grades are formed. A TPH module comprises a ceramic substrate, a printed circuit board, a sealing glue layer, an integrated circuit, and leads.

Nonetheless, because the substrate of the TPH module is a ceramic material, substrate breakage occurs while manufacturing large-size TPH modules. Consequently, the maximum size of current commercial TPH modules is only around 2 to 8 inches (referred to as small size). It is not possible to provide TPH modules with larger sizes, making one-time large-size printing not possible, either.

To solve the problem of manufacturing large-size TPH modules, multiple ceramic substrates are jointed for assembly in the industry. First, multiple ceramic substrates are attached to the printed circuit board, the sealing glue layer, the integrated circuit, and the leads. Then the ceramic substrates are attached to a heat dissipating plate of a long-size TPH module. By using this method, although the effective printing length is increased, the joint precision is poor. The joint gaps and differences in height between ceramic substrates still affect the quality of thermal decalcomania printing.

Accordingly, how to provide a large-size TPH module or one-time large-size printing without influencing the quality of thermal decalcomania printing has become the problem to be solved in this field.

SUMMARY

An objective of the present invention is to provide a method for manufacturing a thermal print head. A large-size thermal print head is formed by disposing a silicon substrate in a carrier with alignment, forming a glaze layer, a thermal resistance layer, an electrode pattern layer, and a passivation layer sequentially, and connecting electrically to a control module.

To achieve the above objective and efficacy, the present invention discloses a method for manufacturing a thermal print head, which comprises steps of: forming a carrier by gluing a first glass substrate and a second glass substrate using glue, forming an opening by cutting the second glass substrate according to a size of a thermal print head, and the carrier including an alignment mark; disposing a silicon substrate in the opening of the carrier according to the alignment mark; disposing a glaze layer on the silicon substrate according to the alignment mark; disposing a thermal resistance layer on the glaze layer according to the alignment mark; disposing an electrode pattern layer on the thermal resistance layer according to the alignment mark; disposing a passivation layer on the electrode pattern layer according to the alignment mark; and connecting electrically a control circuit module to the electrode pattern layer according to the alignment mark.

According to an embodiment of the method for manufacturing a thermal print head according to the present invention, the silicon substrate is a single-crystalline silicon substrate or a polysilicon substrate.

According to an embodiment of the method for manufacturing a thermal print head according to the present invention, the diameter of the silicon substrate is greater than 2 inches.

According to an embodiment of the method for manufacturing a thermal print head according to the present invention, the step of disposing a glaze layer on the silicon substrate further comprises steps of forming a main glaze layer on a surface of the silicon substrate; and forming a plurality of glaze bars spaced at intervals on the surface of the main glaze layer not facing the silicon substrate.

According to an embodiment of the method for manufacturing a thermal print head according to the present invention, the step of disposing a thermal resistance layer on the glaze layer further comprises a step of disposing the thermal resistance layer on the plurality of glaze bars and forming a plurality of bulges corresponding to the plurality of glaze bars.

According to an embodiment of the method for manufacturing a thermal print head according to the present invention, the step of disposing an electrode pattern layer on the thermal resistance layer further comprises steps of forming a conductive metal layer on the surface of the thermal resistance layer not facing the glaze layer; and etching the conductive metal layer on the plurality of glaze bars for exposing the plurality of bulges corresponding to the plurality of glaze bars, respectively.

According to an embodiment of the method for manufacturing a thermal print head according to the present invention, the step of disposing a passivation layer on the electrode pattern layer further comprises a step of partially etching the passivation layer for forming a breach and exposing the electrode pattern layer.

According to an embodiment of the method for manufacturing a thermal print head according to the present invention, the step of connecting electrically a control circuit module to the electrode pattern layer further comprises a step of connecting electrically the control circuit module to the electrode pattern layer through the breach.

DETAILED DESCRIPTION

In order to make the structure and characteristics as well as the effectiveness of the present invention to be further understood and recognized, the detailed description of the present invention is provided as follows along with embodiments and accompanying figures.

According to the prior art, large-size thermal print head modules or one-time large-size printing are not available. The quality of thermal decalcomania printing by jointing substrates is still poor. Accordingly, the present invention provides a method of manufacturing a thermal print head for solving the problems according to the prior art.

In the following, the properties, the structure, and the method according to the method for manufacturing a thermal print head according to the present invention will be further described.

Figure 1:
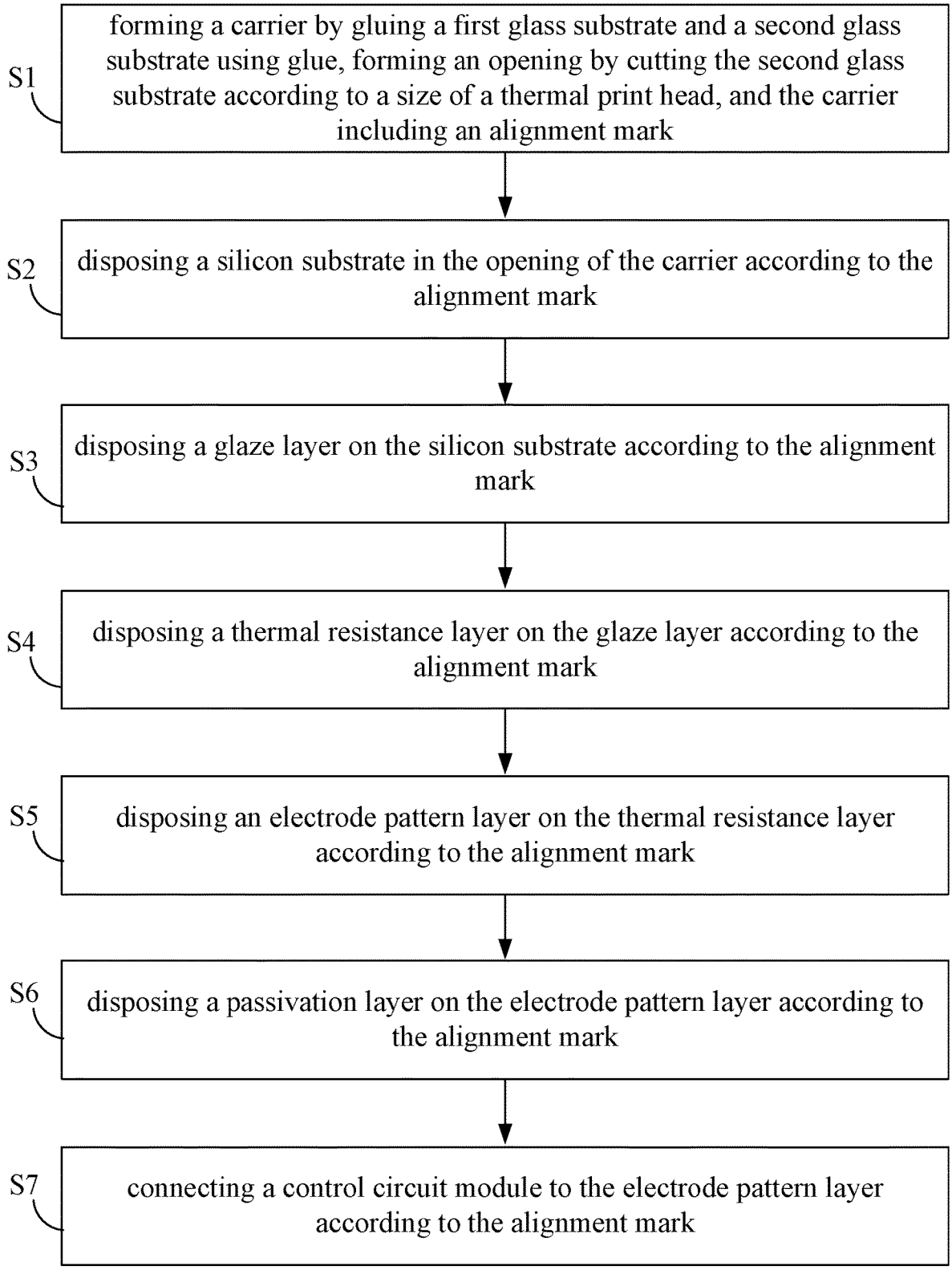
FIG. 1 shows a flowchart according to an embodiment of the present invention.

Please refer to FIG. 1, which shows a flowchart according to an embodiment of the present invention. As shown in the figure, the method for manufacturing a thermal print head according to the preset invention comprises steps of:

S1: Forming a carrier by gluing a first glass substrate and a second glass substrate using glue, forming an opening by cutting the second glass substrate according to a size of a thermal print head, and the carrier including an alignment mark;

S2: Disposing a silicon substrate in the opening of the carrier according to the alignment mark;

S3: Disposing a glaze layer on the silicon substrate according to the alignment mark;

S4: Disposing a thermal resistance layer on the glaze layer according to the alignment mark;

S5: Disposing an electrode pattern layer on the thermal resistance layer according to the alignment mark;

S6: Disposing a passivation layer on the electrode pattern layer according to the alignment mark; and S7: Connecting a control circuit module to the electrode pattern layer according to the alignment mark.

As shown in the step S1, form a carrier 1 by gluing a first glass substrate 11 and a second glass substrate 13 using glue 12; form an opening 131 by cutting the second glass substrate 13 according to a size of a thermal print head; and the carrier 1 includes an alignment mark 132. According to the size of the thermal print head, the opening 131 can be, but not limited to, circular or square. According to a preferred embodiment of the present invention, the opening is circular, corresponding to the shape of a silicon wafer. In addition, the thickness of the carrier 1 is preferably, but not limited to, 1.8±0.05 mm. The temperature for gluing using the glue 12 is preferably, but not limited to, 300° C. The reaction time is preferably, but not limited to, 30 minutes.

The preferred size of the first glass substrate 11 and the second glass substrate 13 is 720 mm in length and 610 mm in width. The preferred marking range of the alignment mark 132 is 15±0.01 mm in length and 5±0.01 mm in width.

Next, as shown in the step S2, dispose a silicon substrate 2 in the opening 131 of the carrier 1 according to the alignment mark, where the silicon substrate 2 is a single-crystalline silicon substrate or a polysilicon substrate, and the diameter of the silicon substrate 2 is greater than 2 inches. Besides, after the silicon substrate 2 is disposed in the opening 131, the height of the silicon substrate 2 is greater than the height of the second glass substrate 13.

Afterwards, as shown in the step S3, dispose a glaze layer 3 on the silicon substrate 2 according to the alignment mark 132. The step S3 further comprises:

S31: Forming a main glaze layer on a surface of the silicon substrate; and

S32: Forming a plurality of glaze bars spaced at intervals on the surface of the main glaze layer not facing the silicon substrate.

As shown in the step S31, adopt the screen printing technique to uniformly coat a glaze pulp layer, which will become a main glaze layer 31 subsequently, on one surface of the silicon substrate 2 and sinter and solidify the glaze pulp at high temperatures (1000~1200° C.). Thereby, the main glaze layer 31 can be used for reserving heat, making heat not dissipate easily. Next, as shown in the step S32, adopt the screen printing technique to uniformly coat a plurality of glaze bars 32 on the surface of the main glaze layer 31 not facing the silicon substrate 2. The plurality of glaze bars 32 are spaced at intervals on the main glaze layer 31. In addition, the plurality of glaze bars 32 are straight and formed continuously on the main glaze layer 31.

Moreover, as shown in the step S4, dispose a thermal resistance layer 4 on the glaze layer 3 according to the alignment mark 132. The step S4 further comprises:

S41: Disposing the thermal resistance layer on the glaze bars and forming bulges corresponding to the glaze bars.

As shown in the step S41, dispose the thermal resistance layer 4 on the main glaze layer 31 and the plurality of glaze bars 32, and form a plurality of bulges 41 on and corresponding to the plurality of glaze bars 32.

Then, as shown in the step S5, dispose an electrode pattern layer 5 on the thermal resistance layer 4 according to the alignment mark 132. The step S5 further comprises:

S51: Forming a conductive metal layer on the surface of the thermal resistance layer not facing the glaze layer; and S52: Etching the conductive metal layer on the glaze bars for exposing the bulges corresponding to the glaze bars, respectively.

As shown in the step S51, form a conductive metal layer 51, such as aluminum, copper, silver, or gold, on the surface of the thermal resistance layer 4 not facing the glaze layer 3. Next, as shown in the step S52, after forming the conductive metal layer 51, etch the conductive metal layer 51 on the plurality of glaze bars 32 for forming an etch opening 52 and exposing the plurality of bulges 41 corresponding to the plurality of glaze bars 32, respectively.

In addition, as shown in the step S6, dispose a passivation layer 6 on the electrode pattern layer 5 according to the alignment mark 132. The step S6 further comprises:

S61: Partially etching the passivation layer for forming a breach and exposing the electrode pattern layer.

As shown in the step S61, dispose the passivation layer 6 on the electrode pattern layer 5, where a portion of the passivation layer 6 covers the electrode pattern layer 5 and the other portion of the passivation layer 6 enters the etch opening 52 for covering the plurality of bulges 41 of the thermal resistance layer 4 and being adjacent closely to the thermal resistance layer 4. Next, after forming the passivation layer 6, partially etch the passivation layer 6 for forming a breach 61 and exposing the electrode pattern layer 5.

Finally, as shown in the step S7, connect a control circuit module 7 to the electrode pattern layer 5 according to the alignment mark 132. According to a preferred embodiment, the control circuit module 7 is a combination of a chip-on-film (COF) package structures, operating chips, and circuit boards (printed circuit boards or flexible circuit boards).

Moreover, according to the present embodiment, a heat dissipating structure is further disposed below the silicon substrate 2. Thereby, when the thermal print head is not in use, heat can be dissipated effectively.

Figure 2:
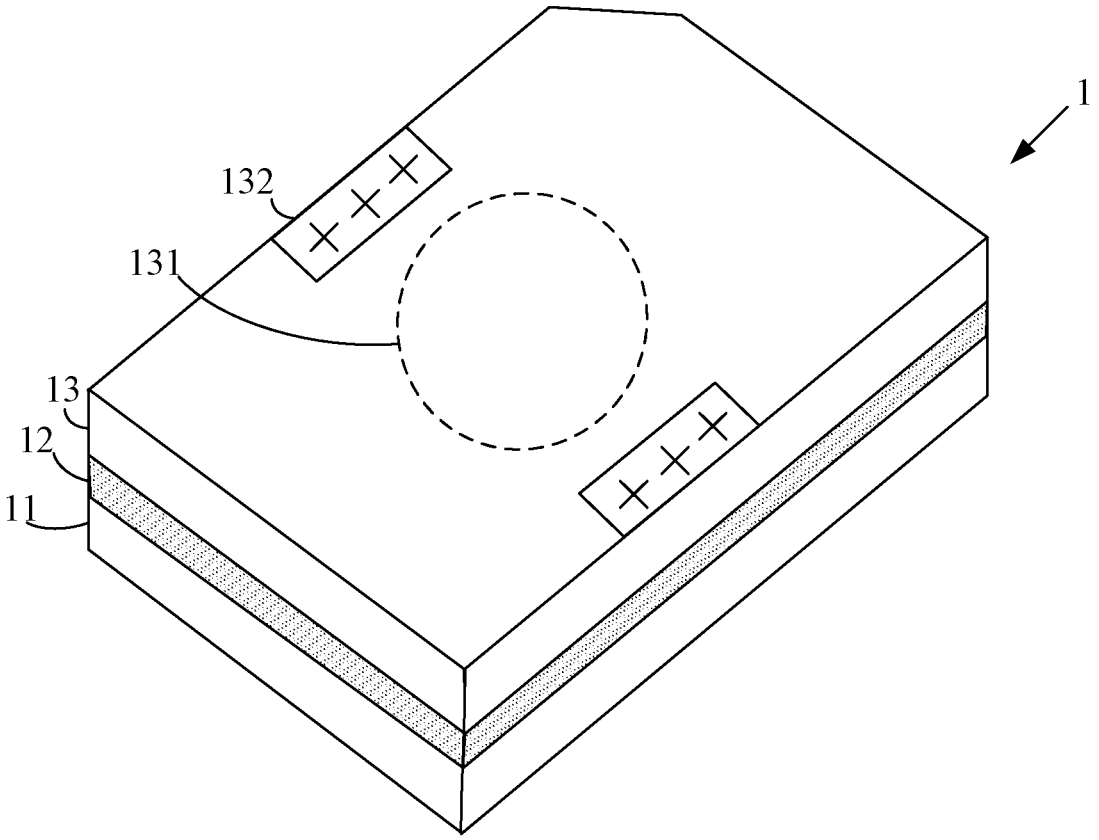
FIG. 2 shows a structural schematic diagram of the carrier according to an embodiment of the present invention.

As shown in FIG. 2, which shows a structural schematic diagram of the carrier according to an embodiment of the present invention. As shown in the figure, the carrier 1 includes the first glass substrate 11 and the second glass substrate 13, which are glued using the glue 12. Besides, the second glass substrate 13 is cut according to the size of the thermal print head for forming the opening 131. To make the subsequent manufacturing method more precise, the carrier 1 includes the alignment mark 132. By means of the carrier 1, the shape of the opening 131 on the carrier 1 can be changed according to customer's requirements, such as large-size thermal print head or one-time large-size printing.

Figure 3:
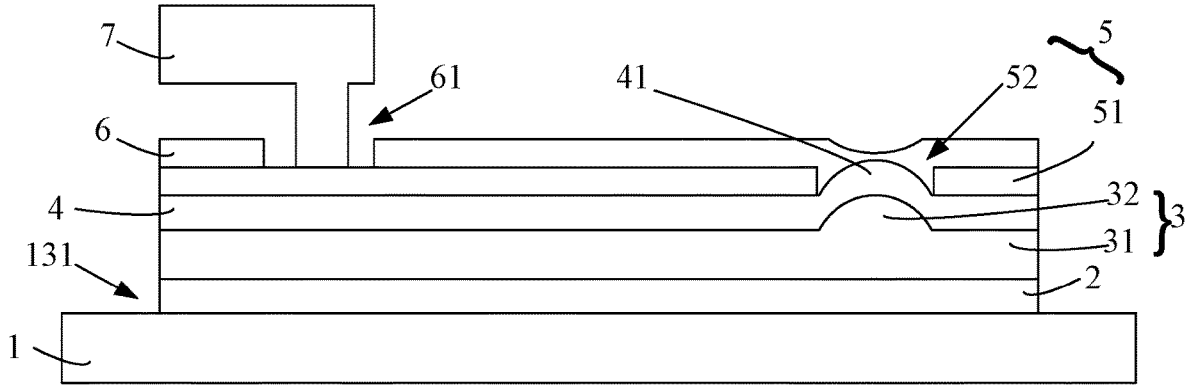
FIG. 3 shows a structural schematic diagram according to an embodiment of the present invention.

Finally, as shown in FIG. 3, which shows a structural schematic diagram according to an embodiment of the present invention. As shown in the figure, the thermal print head is grown sequentially from the silicon substrate 2 on the carrier 1. The thermal print head includes sequentially the silicon substrate 2, the glaze layer 3, the thermal resistance layer 4, the electrode pattern layer 5, the passivation layer 6, and the control circuit module 7.

Adopt the screen printing technique to uniformly coat a glaze pulp layer, which will become a main glaze layer 31 subsequently, on one surface of the silicon substrate 2 and sinter and solidify the glaze pulp at high temperatures (1000~1200° C.). Adopt the screen printing technique to uniformly coat a plurality of glaze bars 32 on the surface of the main glaze layer 31 not facing the silicon substrate 2. Next, dispose the thermal resistance layer 4 on the main glaze layer 31 and the plurality of glaze bars 32, and forming a plurality of bulges 41 on and corresponding to the plurality of glaze bars 32.

Furthermore, form the conductive metal layer 51, such as aluminum, copper, silver, or gold, on the surface of the thermal resistance layer 4 not facing the glaze layer 3. After forming the conductive metal layer 51, etch the conductive metal layer 51 on the plurality of glaze bars 32 for forming an etch opening 52 and exposing the plurality of bulges 41 corresponding to the plurality of glaze bars 32, respectively. Then, dispose the passivation layer 6 on the electrode pattern layer 5, where a portion of the passivation layer 6 covers the electrode pattern layer 5 and the other portion of the passivation layer 6 enters the etch opening 52 for covering the plurality of bulges 41 of the thermal resistance layer 4 and being adjacent closely to the thermal resistance layer 4. Next, after forming the passivation layer 6, partially etch the passivation layer 6 for forming a breach 61 and exposing the electrode pattern layer 5.

Finally, according to the alignment mark 132, connect electrically the control circuit module 7 to the electrode pattern layer 5 through the breach 61. Moreover, the silicon substrate 2 is a single-crystalline silicon substrate or a polysilicon substrate. The spacing between the plurality of glaze bars 32 is, but not limited to, 0.5~2 cm.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A method for manufacturing a thermal print head, comprising steps of:

forming a carrier by gluing a first glass substrate and a second glass substrate using glue, forming an opening by cutting said second glass substrate according to a size of a thermal print head, and said carrier including an alignment mark;

disposing a silicon substrate in said opening of said carrier according to said alignment mark;

disposing a glaze layer on said silicon substrate according to said alignment mark;

disposing a thermal resistance layer on said glaze layer according to said alignment mark;

disposing an electrode pattern layer on said thermal resistance layer according to said alignment mark;

disposing a passivation layer on said electrode pattern layer according to said alignment mark, and partially etching said passivation layer for forming a breach and exposing said electrode pattern layer; and connecting a control circuit module to said electrode pattern layer according to said alignment mark.

2. The method for manufacturing a thermal print head of claim 1, wherein said silicon substrate is a single-crystalline silicon substrate or a polysilicon substrate.

3. The method for manufacturing a thermal print head of claim 1, wherein a diameter of said silicon substrate is greater than 2 inches.

4. The method for manufacturing a thermal print head of claim 1, wherein said step of connecting electrically a control circuit module to said electrode pattern layer further comprises a step of connecting electrically said control circuit module to said electrode pattern layer through said breach.

5. The method for manufacturing a thermal print head of claim 1, wherein said step of disposing a glaze layer on said silicon substrate further comprises steps of:

forming a main glaze layer on a surface of said silicon substrate; and forming a plurality of glaze bars spaced at intervals on the surface of said main glaze layer not facing said silicon substrate.

6. The method for manufacturing a thermal print head of claim 5, wherein said step of disposing a thermal resistance layer on said glaze layer further comprises a step of disposing said thermal resistance layer on said plurality of glaze bars and forming a plurality of bulges corresponding to said plurality of glaze bars.

7. The method for manufacturing a thermal print head of claim 6, wherein said step of disposing an electrode pattern layer on said thermal resistance layer further comprises steps of:

forming a conductive metal layer on the surface of said thermal resistance layer not facing said glaze layer; and etching said conductive metal layer on said plurality of glaze bars for exposing said plurality of bulges corresponding to said plurality of glaze bars, respectively.

* * * * *